United States Patent [19]

Thanisch

[11] Patent Number: 4,998,649

[45] Date of Patent: Mar. 12, 1991

[54] RETRACTABLE TURNSPOUT CLOSURE

[76] Inventor: Klaus J. Thanisch, Am Rosenkreuz 6, 5583 Zell/Mosel, Fed. Rep. of Germany

[21] Appl. No.: 77,909

[22] Filed: Jul. 27, 1987

[51] Int. Cl.[5] ..... B67D 3/00

[52] U.S. Cl. ..... 222/507; 222/212; 222/536; 222/538

[58] Field of Search ..... 222/507, 533, 536, 553, 222/538, 534, 535, 153, 542, 206, 215, 212, 211

[56] References Cited

U.S. PATENT DOCUMENTS

| | | | |
|---|---|---|---|
| 2,127,424 | 8/1938 | Rolle | 222/542 |
| 2,903,168 | 9/1959 | Sutliffe | 222/553 |
| 2,924,393 | 2/1960 | Robert | 222/553 X |
| 3,094,255 | 6/1963 | Hunter | 222/507 |
| 3,371,827 | 3/1968 | Micallef | 222/507 |
| 3,847,313 | 11/1974 | Micallef | 222/507 |
| 4,013,200 | 3/1977 | Tripp | 222/536 X |
| 4,591,079 | 5/1986 | Bigotte | 222/538 |
| 4,779,773 | 10/1988 | Bennett | 222/507 |

FOREIGN PATENT DOCUMENTS

| | | | |
|---|---|---|---|
| 2214135 | 10/1973 | Fed. Rep. of Germany | 222/402.11 |
| WO87/06503 | 11/1987 | PCT Int'l Appl. | 222/530 |
| 2112761 | 7/1983 | United Kingdom | 222/561 |

*Primary Examiner*—Kevin P. Shaver

[57] ABSTRACT

A retractable turnspout closure for a flexible container comprises a plug mounted across the neck of the container, the plug having an offset opening and a valve member mounted over the opening and having the turnspout's turret mounted thereon. A cap mounted over the bottle's neck comprises an eccentrically oriented boss which abuts the plug base and causes the turnspout to extend or retract through a cap opening as the cap is rotated. When the turnspout is completely retracted a double seal exists comprising the cap wall and a shield extending upward from the plug base.

5 Claims, 3 Drawing Sheets

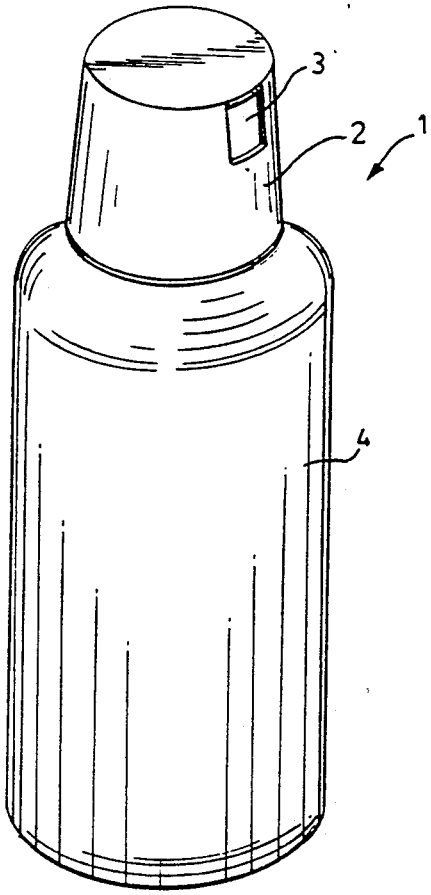
FIG.1
FIG.3
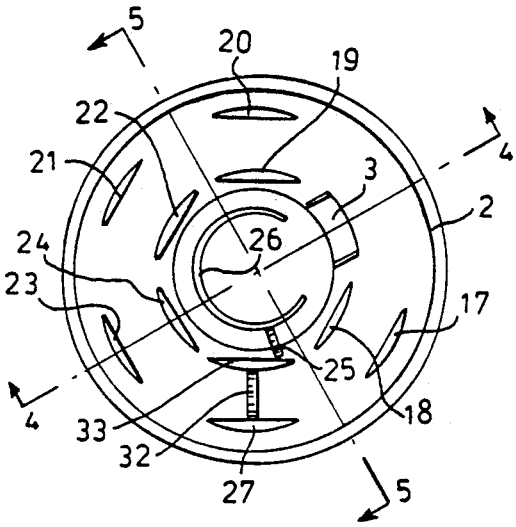
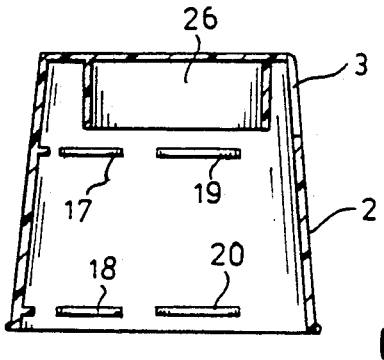
FIG.4
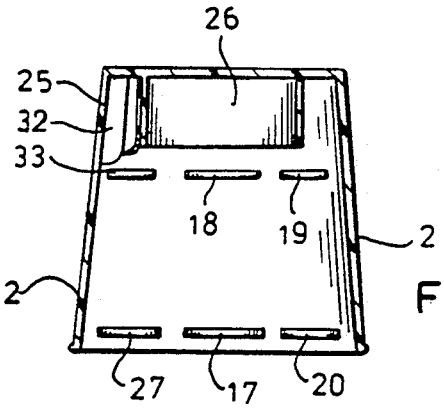
FIG.5

RETRACTABLE TURNSPOUT CLOSURE

BACKGROUND OF THE INVENTION

1. Field of the Invention

The invention relates to a retractable turnspout closure for a container such as may be used to dispense liquids of varying viscosities such as mustard, ketchup, and shaving cream.

2. Description of the Prior Art

A prior art retractable turnspout closure is found in U.S. Pat. No. 3,847,313. The turnspout closure shown therein comprised a plug with an eccentrically located opening extending across the top of a container neck and a rotatable stout having a passage therethrough for dispensing the contents of the container and including a valve plug portion which cooperates with the valve seat in providing a valve adapted to be open to permit discharge of the container contents to the turnspout enclosed to seal the passage. The closure further comprises a cap having a lateral opening extending over the turnspout and plug and being adapted to be rotated in one direction and including a contact member for engaging the spout to turn it and extend it out through the lateral opening. The turnspout further comprises cooperating ramps between the spout and the plug which raise the turnspout and consequently the valve plug member to open the valve during rotation of the turnspout. A reverse rotation causes the contact surface thereon to engage the turnspout and retract it inwardly relative to the cap. During this movement, a ramp on the cap engages the turnspout to shift it downwardly to close the valve. A child safety feature is provided which requires a deliberate shifting inwardly of a shield to dispense the container contents by the intended user. Another relevant prior art reference is U.S. Pat. No. 3,371,827, which was assigned to the assignee of the present invention. The reference discloses a dispensing cap for a container which includes a rotatable valve spout and a cap. When the cap is turned in opposite directions the spout is moved through cam action to respectively project through and to be retracted from an opening in the cap.

OBJECTIVES AND SUMMARY OF THE INVENTION

It is an object of the present invention to provide a retractable turnspout closure with a valving structure designed to prevent clogging of the turnspout. It is a further object to provide two zones of sealing so as to prevent contamination of the container contents from the ambient atmosphere. It is a still further object of the invention to provide a retractable turnspout closure which is simpler in function than the prior art turnspouts. These and other objectives and advantages of the invention will become apparent from the following summary.

The retractable rotatable turnspout closure of the present invention comprises a plug having a base extending across an opening defined by a neck of a container, an opening in said base, and a valve seat forming part of a valve disposed about said opening; a rotatable spout having a passage therethrough for cooperating with the valve and directing the container contents during discharge therefrom, and a valve member also forming part of the valve comprising a cylinder extending upward from the plug base and having an opening within said cylinder which cooperates with said retractable rotatable turnspout such that a passageway is formed through said turnspout and said member when said turnspout is fully extended; a rotatable cap extending over the plug and having an opening through which the retractable spout is adapted to project when it is fully extended at which time said passageway exists through said turnspout and said valve member opening; a projecting member having a contact edge for contacting the spout and moving it from its retracted to its projecting position upon rotation of the cap in one direction; said opening in said valve member being located such that it only parallels said opening in said turnspout when the turnspout is in the fully extended position.

From the above, it should be clear that the present invention provides for a much simpler retraction and extension of the spout than is provided by the cam and follower means of previously mentioned U.S. Pat. No. 3,371,837 or the valve member having an up and down movement provided in the aforementioned U.S. Pat. No. 3,847,313.

BRIEF DESCRIPTION OF THE DRAWINGS

FIG. 1 is a perspective view of the retractable turnspout closure of the present invention mounted on a container.

FIG. 3 is a bottom view of the cap member of FIG. 2, taken along lines 3—3 of FIG. 2.

FIG. 4 is a sectional view of the element of FIG. 3 taken along 4—4 of FIG. 3.

FIG. 5 is another sectional view of the element of FIG. 3 taken along 5—5 of FIG. 3.

DETAILED DESCRIPTION OF THE INVENTION

FIG. 1 shows the retractable turnspout closure 1 of the present invention, which comprises a cap 2 having an opening 3 which is affixed to a container 4. Although the container 4 need not be flexible, it will be assumed to be so for the purposes of this description.

Figure 2:
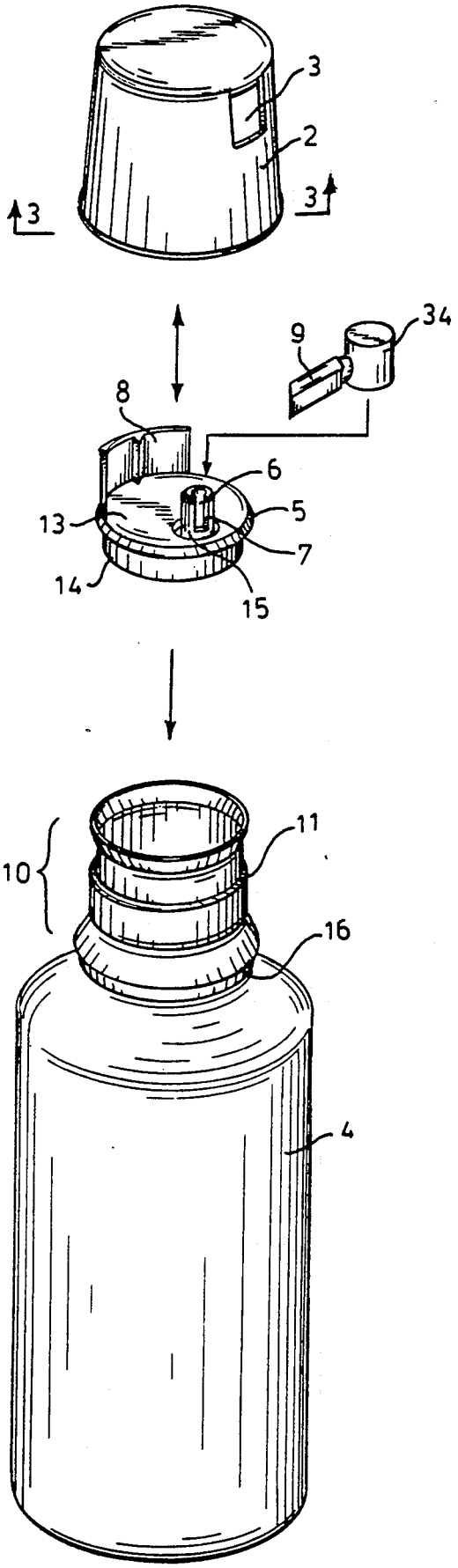
FIG. 2 is an exploded view of the elements shown in FIG. 1.

FIG. 2 is an exploded view of the components of FIG. 1. The Figure shows internal components including a plug 5, a valve seat 6, an opening 7 in the valve seat 6, a shield 8 which with the wall of cap 2 forms a double seal over the turnspout when it is fully retracted and, a turnspout 9 having a turret 34.

The plug 5 rests on an upper lip 11 of the neck 10 of container 4. Extending downward from the plug base 13 is a depending annular apron 14 defining a plug portion for frictionally engaging with the interior surfaces of the container neck 10. The plug base 13 is provided with an opening 15 which is offset from the center of the base and through which the container contents are adapted to pass. The turret of turnspout 9 fits over valve 6. Also shown on neck 10 is an exterior closure retaining head 16.

FIG. 3 shows a bottom sectional view of the cap 2. Shown therein are opening 3, locking lugs 17–24, 27 and 33 with only the lower locking lugs 17, 20, 21, 23 and 27 functioning to retain the cap 2 on the container neck 10 since no movement in the height of the closure takes place. Stop gate 32 functions when in contact with the shield 8 to arrest rotary movement of the cap 2 and thus the spout when the spout is fully extended. When the spout is fully extended it is located at an approximately 90° angle to a longitudinal line through the center of the container. A boss (ring) 26 projects downward and thus guides the spout in and out as far as the rotary motion is limited by any other stop member (gate). Projecting gate 25 serves to arrest the rotary movement of the cap 2 when it contacts shield 8 and thus is in a closed position with the turnspout 9 retracted therein.

FIG. 4 is a sectional view taken along the line 4—4 of FIG. 3. Shown therein are cap 2, opening 3 downward projecting boss 26, and locking lugs 17–20, 27 and 33.

FIG. 5 is a sectional view taken along the line 5—5 of FIG. 3. Shown therein are cap 2, locking lugs 17–20, 27, and 33, stop member 32 and stop member 25. Stop members 25 and 32 are mounted on the cap well and respectively function to abut and thus stop rotational movement of the turnspout 9 when the turnspout 9 is in a fully extended or fully retracted position.

Figure 6:
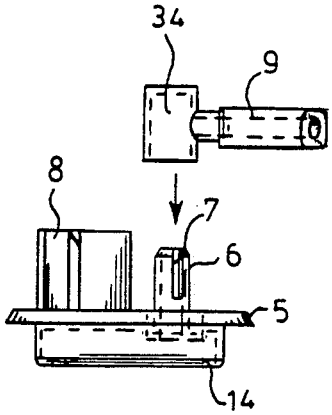
FIG. 6 is an elevational view of the plug and turnspout elements of the present invention.

FIG. 6 shows the connection of the turret 34 of the spout 9 to the valve 6 having an opening 7 which is mounted on plug 5. Also shown is shield 8 mounted on plug 5.

Figure 7:
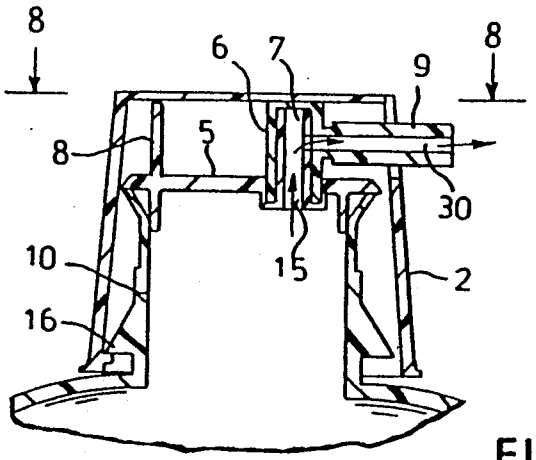
FIG. 7 is a sectional elevational view of the plug, valve, turnspout and cap of the present invention.
Figure 9:
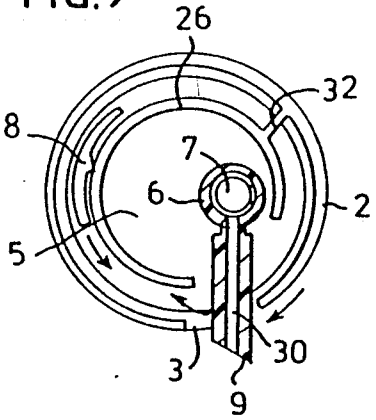
FIGS. 9–12 are, like FIG. 8, a top view of the components of FIG. 7, showing the relative orientation of these components during different stages of rotation of the cap.
Figure 11:
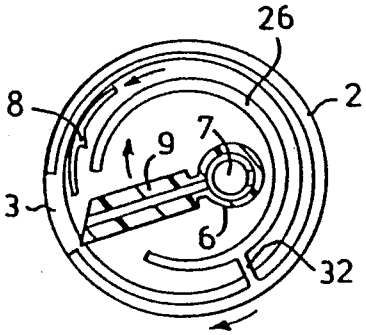
Figure 10:
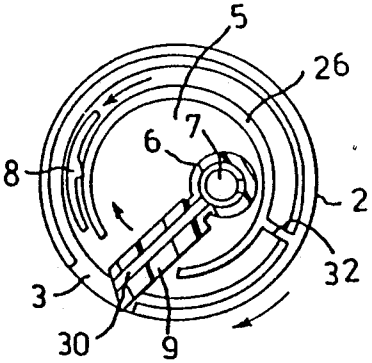

FIG. 7 is a sectional view of the cap 2 and plug 5 showing the turnspout 9 fully extended through the cap opening. Also shown therein are the opening 15 in the plug for allowing contents from the container to be dispensed through opening 7 in valve 6, and the projecting external member 16 of the container neck 10.

Figure 8:
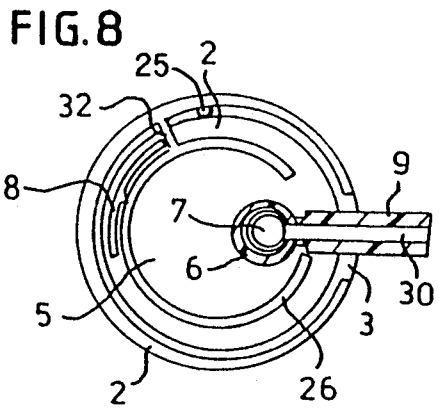
FIG. 8 is a top view of the elements of FIG. 8 taken along the lines 8—8 of FIG. 7.

FIG. 8 is a top sectional view of the elements in FIG. 7 taken along line 8—8. As shown therein turnspout 9 is fully extended through the opening 3 in cap 2 and a passageway exists from the container through the opening 7 of valve 6 which is mounted on plug 5 for conveying contents of the container through the passageway 30 in turnspout 9. Also shown is downward projecting member 26 which abuts turnspout 9 when it is in a completely retracted position as shown in FIG. 12.

FIGS. 8–12 show the changes of position of turnspout 9 relative to the other elements as it progresses from a fully extended to a fully retracted position.

Figure 12:
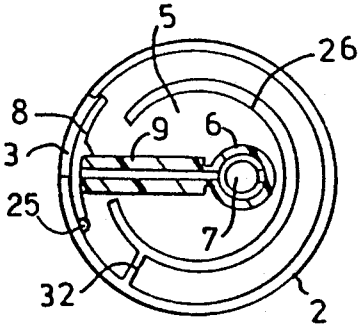

In the completely retracted position shown in FIG. 12, a double seal is provided comprising the wall of cap 2 and shield 8.

An additional feature of the invention resides in the fact that squeezing and then releasing the flexible container causes a partial vacuum in the container which allows air to rush in through opening 30 and valve member opening 7 to clear away portions of the dispensed material remaining within the dispensing channel.

Another feature of the invention is that, in distinction to the aforementioned prior art, the turnspout is oriented substantially perpendicularly to the longitudinal axis of the container.

Although a preferred embodiment of the invention has been disclosed and described in detail herein, it should be understood that this invention is in no sense limited thereby and its scope is to be determined by that of the appended claims.

What is claimed is:

1. A retractable turnspout closure for a container comprising:

a plug base for mounting across a neck of said container, said plug base having an opening offset from its center;

a valve seat mounted on said plug base over said plug base opening;

a retractable and rotatable turnspout having a turret which mounts on said valve seat;

a rotatable cap having an opening in a side wall thereof, a plurality of inwardly projecting members from said side wall, and a boss mounted on and projecting downward from a top of the cap, said boss including means to guidedly engage said retractable and rotatable turnspout and rotate it eccentrically in response to a turning of said cap to a first position wherein said turnspout extends through said opening and a passageway is thus formed from the container's interior through said valve member and an opening in said turnspout leading to the atmosphere outside the container, and further comprising a shield member mounted on said plug base to abut an end of said turnspout and thus to block said passageway when said turnspout is rotated into a second retracted position, said shield member having an outer surface in sliding contact with the inner surface of the cap whereby, said shield with said cap side wall substantially forms a double seal for said turnspout when said turnpoint is in said second position.

2. The retractable turnspout closure of claim 1 further comprising a pair of stop members mounted on said cap wall and respectively abutting ends of said shield and thus stopping said turnspout when said turnspout is rotated into said first fully extended position and into said second fully retracted position.

3. The retractable turnspout closure of claim 1 wherein the container is flexible, the flexing of the walls of the container facilitating the dispensing under pressure of the product contained in the container and the sucking of product back into the container to reduce clogging of the turnspout with the product.

4. The retractable turnspout closure of claim 1 further comprising a plurality of locking lugs projecting from an inside surface of the cap and functioning to retain the cap on said container neck.

5. The retractable turnspout closure of claim 1 wherein said turnspout, and said boss are rotated in a common plane of rotation.

* * * * *